US005261310A

United States Patent [19]

Sullivan et al.

[11] Patent Number: 5,261,310

[45] Date of Patent: Nov. 16, 1993

[54] APPARATUS FOR AUTOLOADING TANK CANNONS

[75] Inventors: Mary B. Sullivan, Lititz, Pa.; James M. VanDerwerken, Schoharie, N.Y.; Robert E. Chiabrandy, Burlington, Vt.

[73] Assignee: General Electric Co., Pittsfield, Mass.

[21] Appl. No.: 819,546

[22] Filed: Jan. 10, 1992

[51] Int. Cl.[5] ..... F41A 9/21

[52] U.S. Cl. ..... 89/46

[58] Field of Search ..... 89/36.13, 45, 46, 47

[56] References Cited

U.S. PATENT DOCUMENTS

| | | | |
|---|---|---|---|
| 457,293 | 4/1891 | Spiller | 89/46 |
| 811,797 | 2/1906 | Schneider | 89/46 |
| 3,106,866 | 10/1963 | Klapdohr et al. | 89/45 |
| 3,134,303 | 5/1964 | Sahlberg | 89/45 |
| 3,988,962 | 11/1976 | Elwin | 89/46 |
| 4,038,906 | 8/1977 | Tidstrom | 89/46 |
| 4,381,693 | 5/1983 | Dumez | 89/36.13 |
| 4,388,854 | 6/1983 | Dabrowski et al. | 89/46 |
| 4,391,179 | 7/1983 | Tidstrom | 89/46 |
| 4,429,616 | 2/1984 | Grosser | 89/36.13 |
| 4,438,677 | 3/1984 | Spotzl et al. | 89/36.13 |
| 4,442,753 | 4/1984 | Pouri et al. | 89/46 |
| 4,481,862 | 11/1984 | Wiethoff et al. | 89/46 |
| 4,495,853 | 1/1985 | Gottwaldt | 89/46 |
| 4,727,790 | 3/1988 | Dehaven et al. | 89/46 |
| 4,763,559 | 8/1988 | Bouillon | 89/33.04 |
| 4,823,675 | 4/1989 | Schiele et al. | 89/46 |
| 4,833,969 | 5/1989 | Winkler et al. | 89/36.13 |
| 4,838,144 | 6/1989 | Bierwirth et al. | 89/46 |
| 5,131,316 | 7/1992 | Lawrence et al. | 89/46 |

FOREIGN PATENT DOCUMENTS

| | | | |
|---|---|---|---|
| 100865 | 2/1941 | Sweden | 89/46 |

*Primary Examiner*—Stephen C. Bentley
*Attorney, Agent, or Firm*—S. A. Young

[57] ABSTRACT

To serve a turret-mounted tank cannon, automated loading apparatus includes a pair of arcuate guide tracks vertically mounted to the turret. The guide tracks, lying on radii centered with the cannon elevating axis, guide a trolley for movement between magazine and cannon loading postions. A rammer, carried by the trolley, is activated to retrieve an ammunition round from magazine storage and to ram the round into the cannon breech regardless of cannon position in elevation and azimuth. The trolley is propelled by a ballscrew, while the rammer is activated by a ballscrew and stiff-backed chain arrangement to achieve an extra long rammer stroke. The rammer is pivotally mounted to the trolley for movement between essentially opposite end-for-end orientations to permit round retrieval from ammunition magazines located in the turret bustle and tank hull, as well as in the turret basket.

22 Claims, 7 Drawing Sheets

APPARATUS FOR AUTOLOADING TANK CANNONS

The present invention relates to armament systems and particularly to apparatus for automating the handling of large caliber ammunition rounds for turret-mounted cannons carried by armored vehicles, such as tanks.

BACKGROUND OF THE INVENTION

Considerable efforts by armament manufacturers throughout the world have been devoted to developing automated apparatus for handling ammunition for field artillery pieces. This is particularly so in the case of mobile artillery pieces carried by armored vehicles, such as tanks. Presently the tasks of withdrawing rounds from magazine storage and loading them into the breech of a tank cannon are almost universally performed manually. A gun loader is thus an essential member of military tank crew. To accommodate his movement in retrieving shells from a magazine and ramming them into the cannon breech, considerable space must be allotted for these activities within the tank, more typically within the revolving gun turret of the tank. Adequate headroom should be provided so the gun loader can work standing up. Unfortunately, this increases the vertical profile of the tank and thus its target size. The turret must therefore be heavily armored to maximize tank and crew survivability against enemy fire. Of course, heavy armor plating adds tremendously to the weight of a tank, which then calls for a larger engine and drive train.

The factors of high profile and the consequences thereof, the elimination of a gun loader and the consequent space savings, and the prospect of higher firing rates have been the primary motivations in developing a satisfactory autoloader for tank cannons.

Of the numerous autoloaders seen in the prior art, most are highly complex, extraordinarily space-consuming, difficult to maintain and susceptible to frequent malfunction. Many of the existing designs require that the cannon return to a predetermined position, particularly in elevation, before automated loading can be effected. Thus, the cannon must be repeatedly removed from the target for reloading and returned for firing, a significant detriment to firing rate.

SUMMARY OF THE INVENTION

In accordance with the present invention, there is provided improved apparatus for feeding and loading ammunition rounds in a tank cannon without human intervention. The autoloading apparatus of the invention operates to retrieve ammunition rounds from a magazine, convey the rounds to the cannon and ram them into the cannon breech, all on an automated basis. The autoloading apparatus is of an extremely compact construction to operate within an extraordinary small space envelope. Positive control of each round is maintained throughout the process to ensure reliable handling while the tank is travelling over rough terrain. The capability of loading the gun regardless of its position in azimuth and elevation provides for a significant improvement in firing rate. Moreover, the autoloading apparatus of the present invention permits retrieval of a shell from a magazine with a previously loaded shell in the gun breech and ready to fire, thus permitting the step of transferring a shell from the magazine to the gun to be conducted at a reduced pace, therefore minimizing autoloader power requirements without jeopardizing firing rate.

To accomplish these objectives, the autoloader of the present invention includes a trolley which is mounted by a pair of guide tracks for controlled movement between a magazine position where ammunition rounds are retrieved from magazine storage and a gun loading position where rounds are rammed into the breech of a revolving turret-mounted gun. The guide tracks are mounted to the tank turret and are of arcuate configurations with fixed radii centered on the elevation axis of the cannon to accommodate autoloading regardless of cannon elevation. A compact rammer is pivotally mounted to the trolley for powered rotation about a pitch axis and selective positioning to retrieve rounds from ammunition magazines located forwardly in the turret beneath the cannon breech and rearwardly of the cannon breech in turret bustle and tank hull storage areas.

The rammer includes a rammer tube for slidingly receiving an ammunition round and a reciprocating rammer head equipped with a gripper for grabbing the tail end of the round to extract it from magazine storage and, with the rammer tube, positively control the round position on the trolley during transfer to a loading position aligned with the breech bore. The rammer carries an electric motor for reciprocating the rammer via a stroke length multiplying stiff-backed chain and a slider-mounted sprocket mechanism to enable the rammer head to extend beyond the forward end of the rammer tube and into a magazine storage tube for ammunition round retrieval and into the breech bore for round loading.

The invention accordingly comprises the features of construction, combination of elements and arrangement of parts, all as described hereinafter and the scope of the invention will be indicated in the claims.

BRIEF DESCRIPTION OF THE DRAWINGS

For a full understanding of the nature and objects of the present invention, reference may be made to the following Detailed Description taken in connection with the accompanying drawings, in which.

Corresponding reference numerals refer to like parts throughout the several views of the drawings.

DETAILED DESCRIPTION

Figure 1:
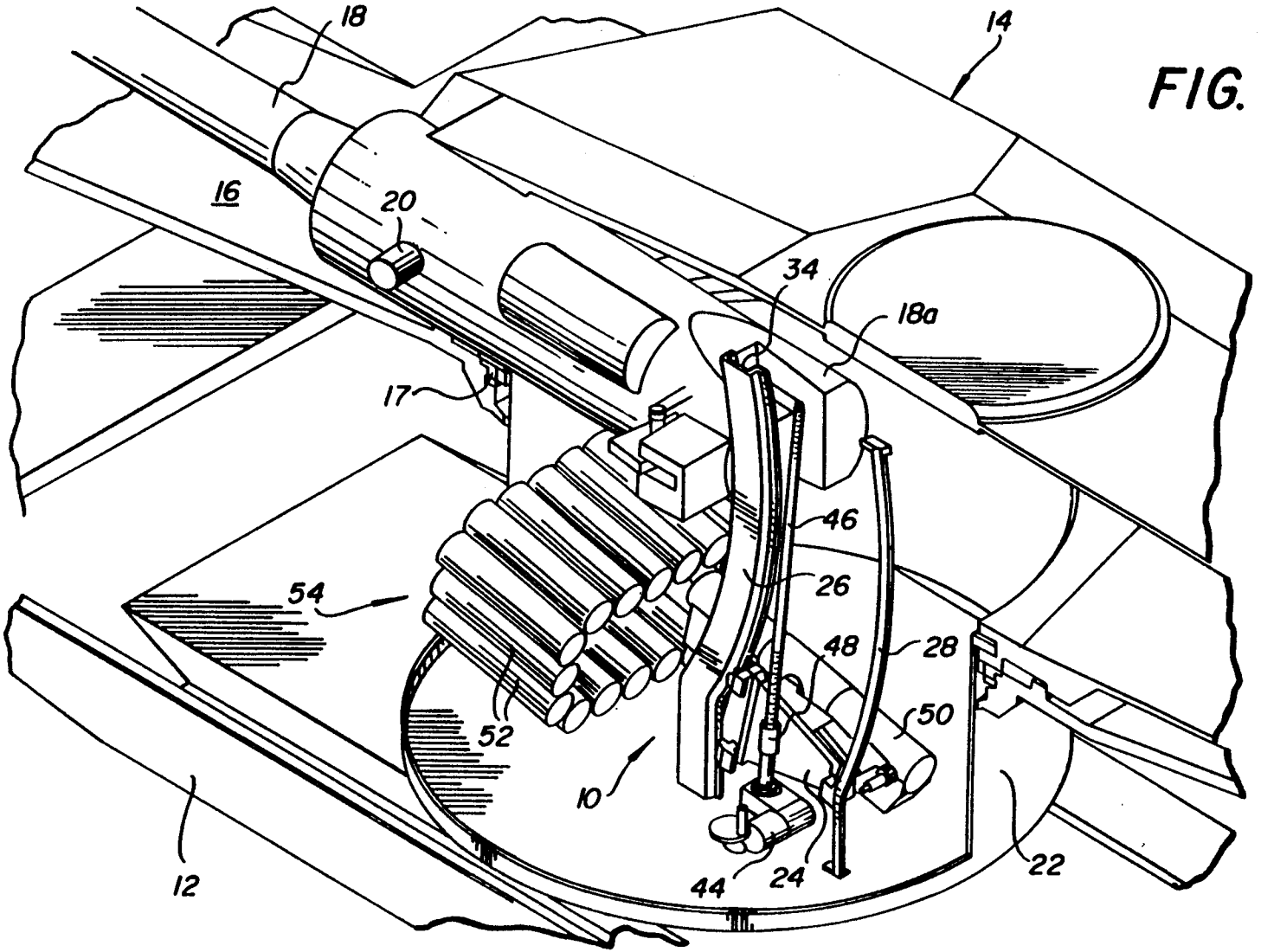
FIG. 1 is a perspective view, partially broken away, of a military tank equipped with automated loading apparatus of the present invention for serving the tank cannon.
Figure 2:
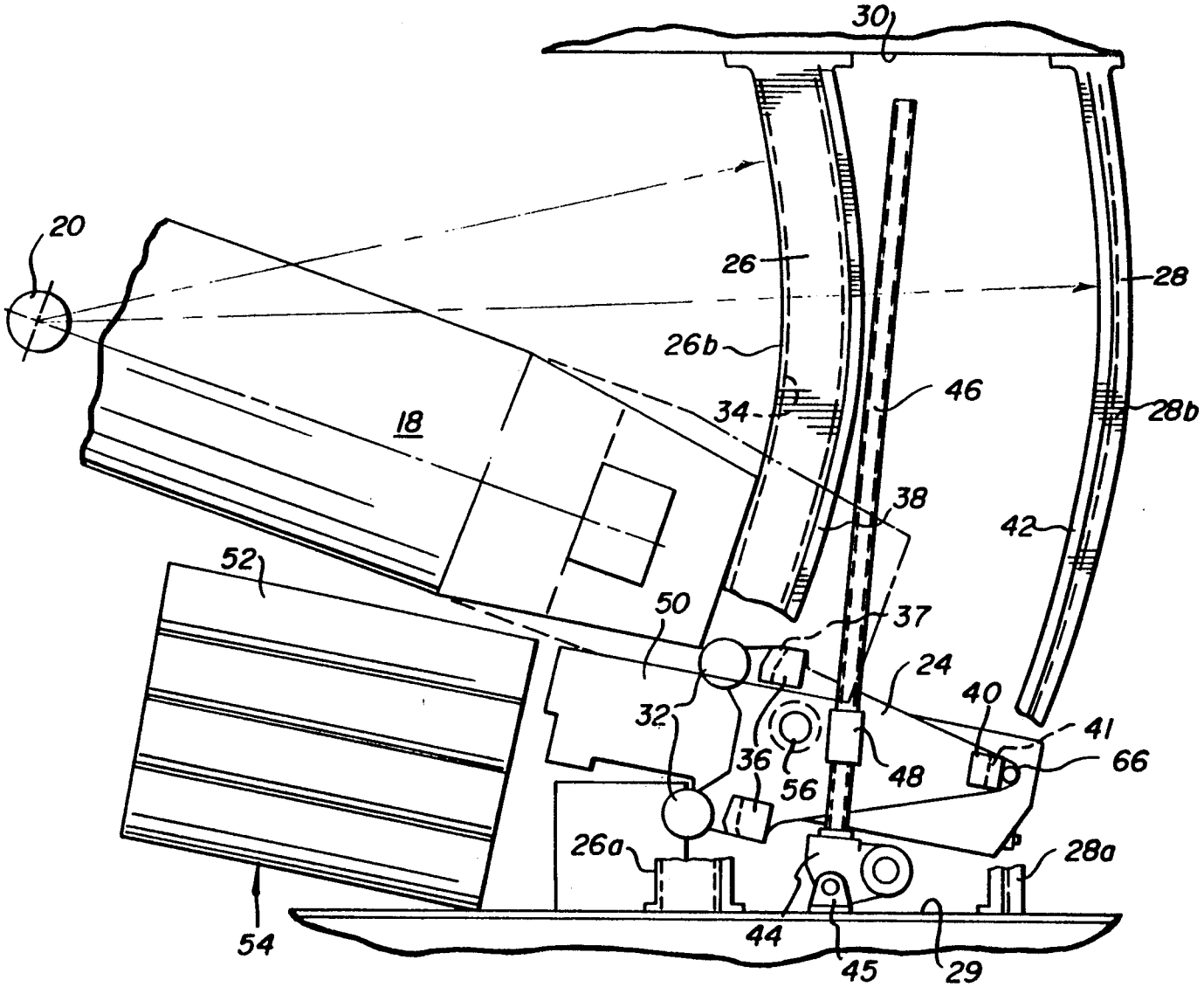
FIG. 2 is a side elevational view, partially broken away, of the autoloading apparatus of FIG. 1.

The autoloading apparatus of the present invention, generally indicated at 10 in FIG. 1, is illustrated in its application to an armored vehicle or tank 12 having an armored turret, generally indicated at 14, which is mounted to the tank deck 16 via bearings 17 for azimuthal revolving movement. The turret, in turn, mounts a cannon 18, via trunnions 20, for independent pivotal movement in elevation. Autoloading apparatus 10 is also mounted to the turret and contained by the turret basket 22. The autoloading apparatus includes a trolley 24 which is controlled in vertical movement by a pitch and roll guide track 26 and yaw guide track 28. As seen in FIG. 2, these guide tracks are anchored at their lower ends to the basket floor 29 and at their upper ends to the turret roof 30. Guide track 26 includes a straight lower vertical section **26*a* which blends into an arcuate upper vertical section 26*b*. The arcuate section has a constant radius of curvature centered on the cannon elevation axis constituted by trunnions 20. Similarly, guide track 28 includes a straight lower vertical section 28*a* blending into an arcuate upper vertical section 28*b*** whose constant radius of curvature is centered on the cannon elevation axis.

Figure 3:
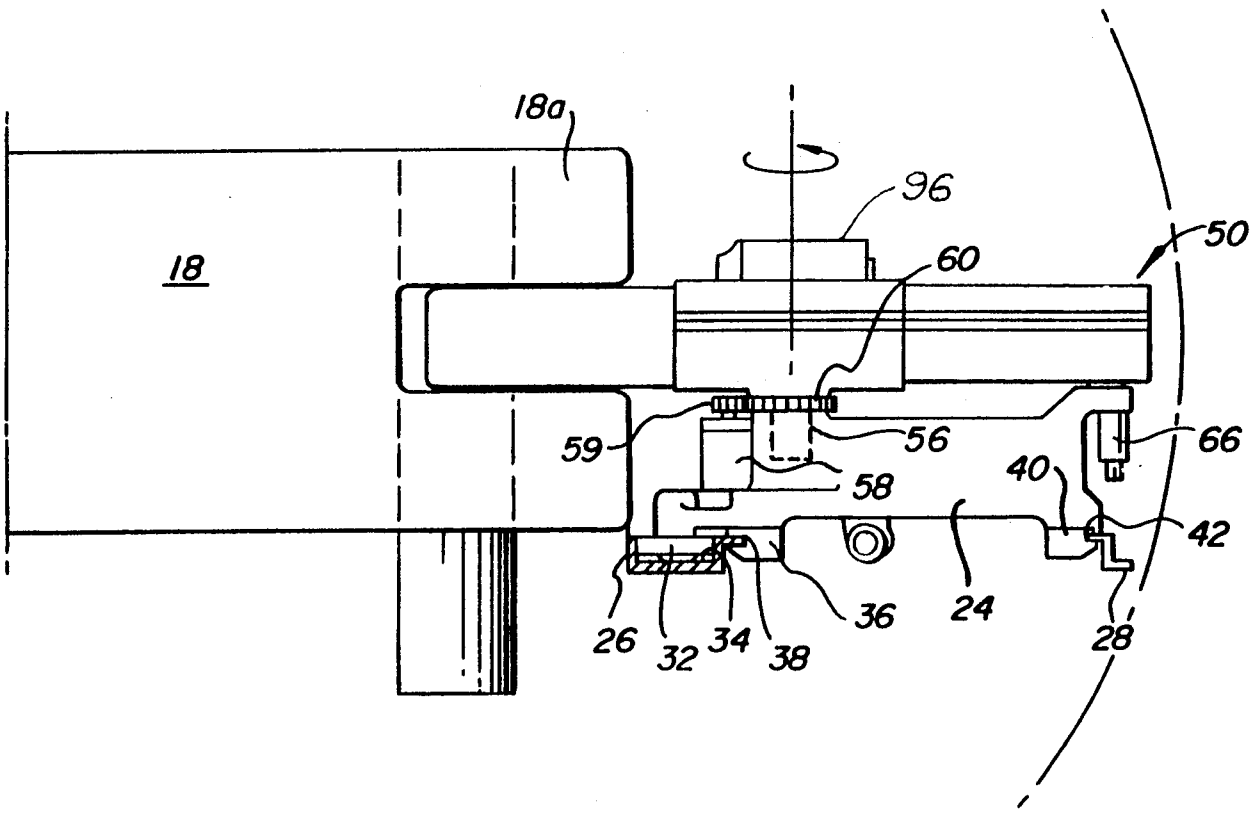
FIG. 3 is a plan view of the autoloading apparatus of FIG. 1, seen in its cannon loading position.

As best seen in FIG. 2, trolley 24 rotatably mounts a pair of vertically spaced rollers 32 at its forward end, which run in a channel-shaped guideway 34 of guide track 26 to control pitch motion of the trolley during its vertical movement. Just rearwardly of the rollers, the trolley mounts a pair of vertically spaced guide blocks 36 provided with grooves 37 to receive in close-fitting, sliding relation a continuous, rearwardly turned rim 38 (FIG. 3). The rim-engaging guide blocks preclude rolling motion of the trolley during vertical movement. To prevent yawing motion of the trolley, it is equipped at its rearward end with a single guide block 40 which is grooved at 41 to receive in close-fitting, sliding relation a forwardly turned flange 42 of guide track 28. To propel vertical movement of the trolley, an electric motor drive unit 44 is pivotally mounted to the basket floor 29 by a bracket 45. The drive unit turns an elongated ball screw 46 extending upwardly between guide tracks 26 and 28 to a free end terminating just short of the turret roof 30, as seen in FIGS. 1 and 2. Meshing with this ball screw is a ball nut 48 pivotally mounted to the trolley. From the description thus far, it is seen that bidirectional rotation of the ball screw by the motor drive unit propels the trolley up and down the guide tracks, with the ball screw swinging on its lower end pivotal mounting to the basket floor and the ball nut turning on its pivotal mounting to the trolley to accommodate articulation of the trolley as it moves along the straight and arcuate sections of the guide tracks.

Mounted to the trolley is a rammer 50 equipped to extract ammunition rounds from storage tubes 52 of a magazine, generally indicated at 54. The magazine includes a carousel conveyor (not shown) operating to bring a storage tube containing a selected ammunition round to a predetermined unloading position in aligned, closely confronting relation with the rammer located by the trolley in the position shown in FIG. 2. As will be described in connection with FIGS. 5–7, the rammer reaches into the storage tube to engage the selected round and extract it out into the rammer where it is held under positive positional control while the trolley ascends the guide tracks to a loading position confronting the open breech **18*a*** of the cannon with the ammunition round aligned with the cannon boreline. The rammer then advances the round forwardly to load the round into the breech bore.

It will be appreciated that, by virtue of the arcuate guide track sections being located on respective radii with the cannon elevation axis, loading can be accomplished regardless of the angle in elevation or depression the cannon is positioned to. Moreover, the steps of retrieving an ammunition round from the magazine and transferring the round toward the cannon breech may be ongoing with the cannon at any position or while elevating or depressing. Note that the length of the round transfer path from magazine to cannon breech varies with cannon elevation. This capability affords a dramatic increase in firing rate as compared to prior art autoloaders.

Figure 4:
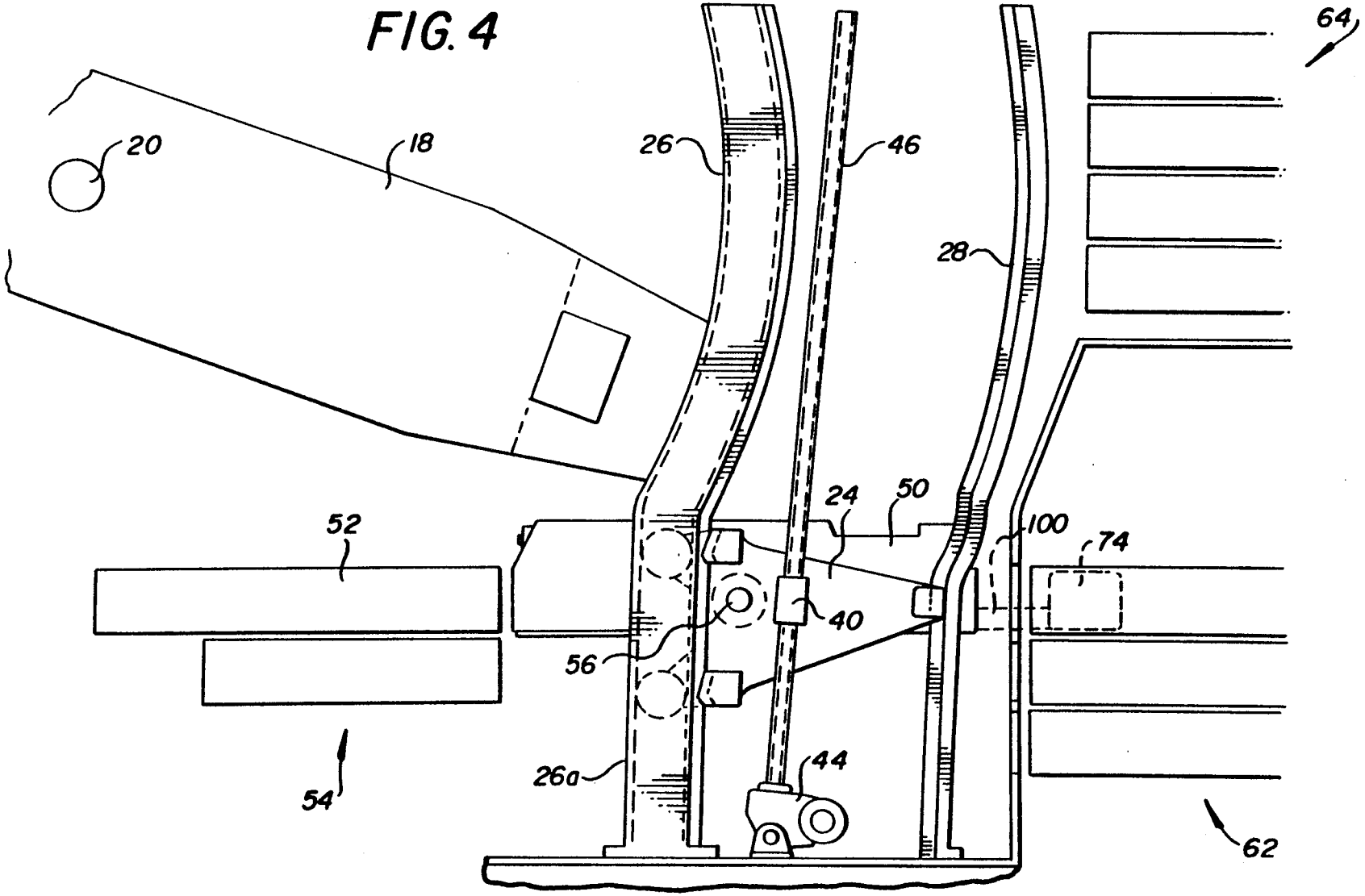
FIG. 4 is a side view similar to FIG. 2 illustrating the capability of the autoloading apparatus of FIG. 1 to access ammunition magazines located in rearward hull and turret bustle storage areas.

As illustrated in FIG. 3, rammer 50 is rotatably mounted to trolley 24 by an axle indicated at 56. The trolley carries a motor 58 which drives, via a pinion gear 59, a spur gear 60 affixed to the rammer in concentric relation with the axle to rotate the rammer end for end. This faculty enables the rammer to retrieve rounds from ammunition magazines 62 and 64 located in a hull storage area, and a bustle storage area, as illustrated in FIG. 4. To access magazine 62 in the hull storage area, trolley 24 is driven to a lower position with its rollers 32 in the portion of trackway 34 in straight section **26*a*, thus positioning the rammer in an essentially horizontal orientation. This trolley position may also be utilized to access turret magazine 54, if oriented horizontally rather than tilted downwardly as illustrated in FIG. 2. It will be appreciated that, since hull storage magazine 62 does not revolve with the cannon, the turret will have to be located in a predetermined azimuth position to enable the rammer to retrieve rounds therefrom. This limitation, of course, does not apply when retrieving rounds from the turret and bustle magazines. A solenoid latch 66, seen in FIGS. 2 and 3**, serves to releaseably lock the rammer to the trolley in requisite pitch position for ramming an ammunition round into the cannon breech and for extracting rounds from a magazine.

Figure 5:
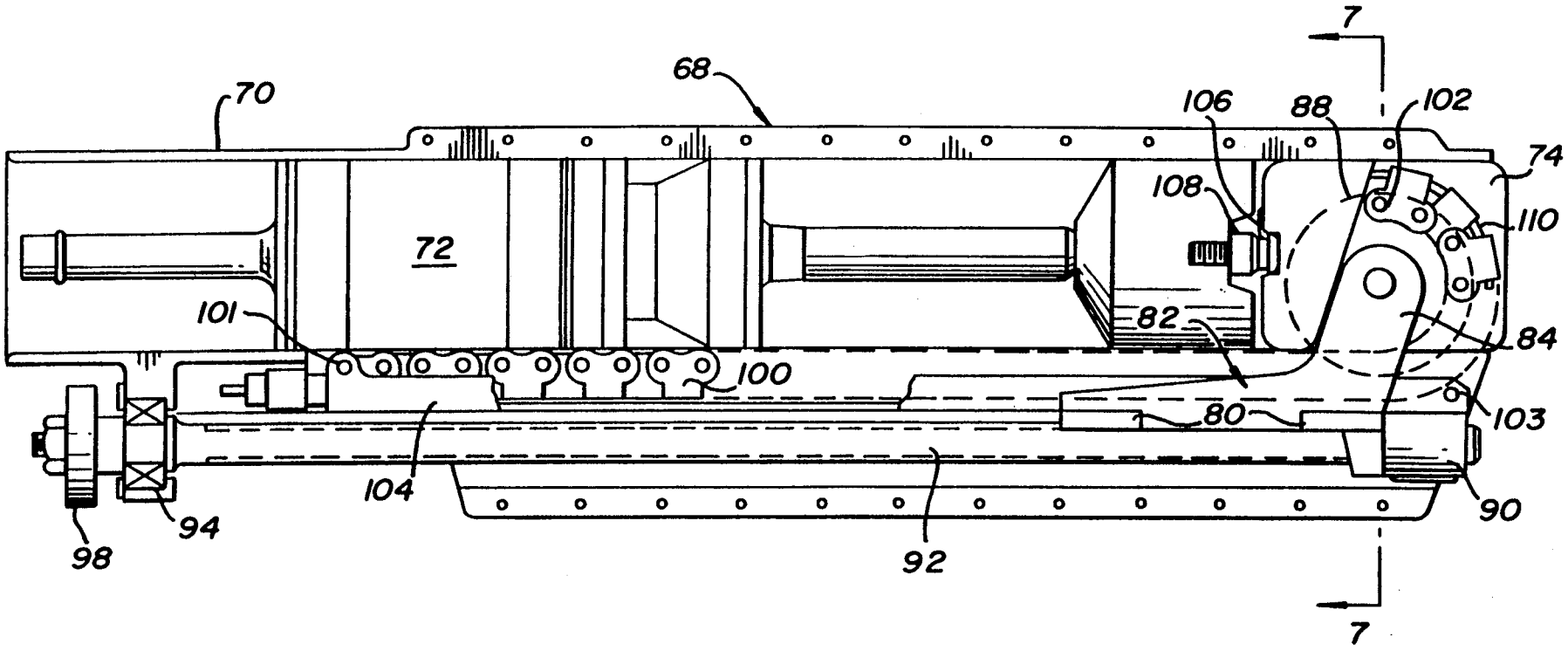
FIGS. 5 and 6 are side views, partially in longitudinal section, of a rammer included in the autoloading apparatus of FIG. 1 and illustrating respective retracted and extended conditions thereof.
Figure 6:
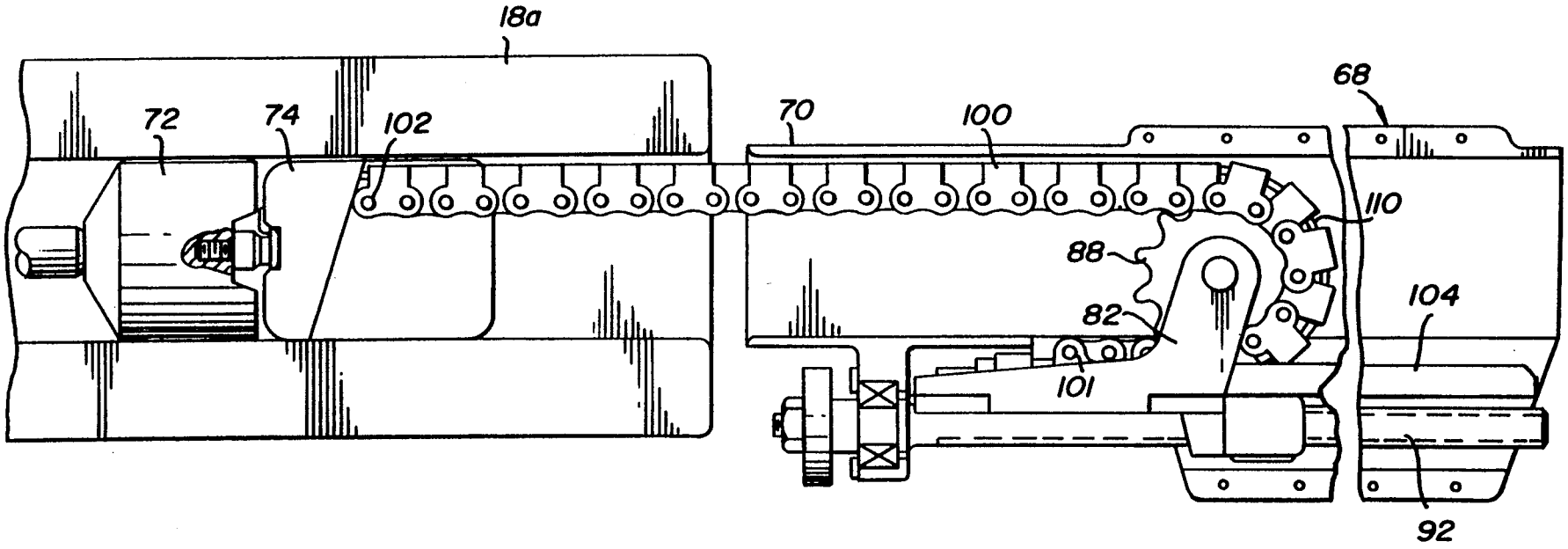
Figure 7:
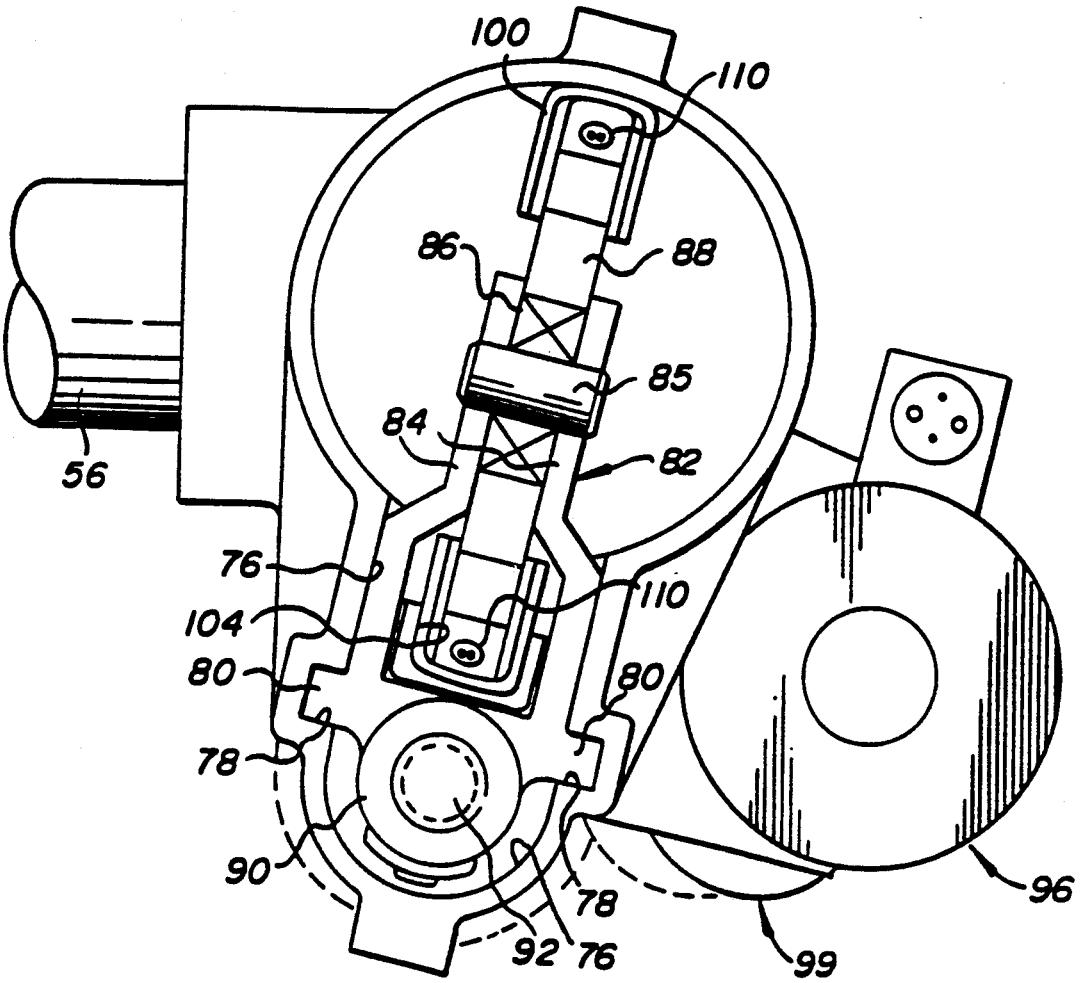
FIG. 7 is a sectional view taken along line 7—7 of FIG. 5.

Rammer 50, as detailed in FIGS. 5–7, includes a housing generally indicated at 68 having an elongated rammer tube 70 for slidingly receiving an ammunition round in the form of a projectile 72 for cannon 18 configured as a liquid propellant cannon. A rammer head 74 is also slidingly received in the rammer tube and is shown in its retracted position in FIG. 5. As best seen in FIG. 7, the lower portion of the rammer tube opens into a trough 76 in which are formed opposed guideways 78 for receiving laterally extending guides 80 of a slider generally indicated at 82. A pair of upstanding slider arms 84 carry between its upper ends a shaft 85 and bearings 86 for journalling a sprocket 88. The lower portion of the slider is threaded to provide a ballnut 90 in meshing engagement with a ballscrew 92 extending through trough 76 and journalled at its forward end by bearing 94 mounted by the housing 68, as seen in FIGS. 5 and 6. An electric motor 96, carried by the rammer housing as seen in FIG. 7, drives the ballscrew via a spur gear 98 keyed to its forward end and a gearset 99 to reciprocate slider 82 parallel to the axis of the rammer tube 70.

A stiff-backed chain 100 is pinned at is forward end to the housing, as indicated at 101, and extends rearwardly through trough 76 and around sprocket 88 to its rearward end pinned to rammer head 74, as indicated at 102. The portion of the chain in the trough is backed by an elongated channel-shaped support 104 mounted in the trough by pins 101 and 103 and extending between the slider arm, as seen in FIG. 7. The characteristic of a stiff-backed chain is that its links will readily pivot in only one direction. Thus, chain 100 can pivot inwardly to train around sprocket 88, but will not sag outwardly. Thus, a linear section will remain stiff to serve as a linear drive element as long as it is backed against outward buckling movement.

As seen in FIG. 5, a solenoid actuated gripper 106 is carried at the face of rammer 74 for releaseably engaging a handling plug 108 provided at the tail end of the projectile 72. A cable 110 (FIG. 7) is threaded through stiff-backed chain 100 for electrically actuating gripper 106 to grip and release handling plug 108 as required.

From the foregoing description of rammer 50, it is seen that, with rammer head 74 in its retracted position of FIG. 5, forward rotation of ballscrew 92 by motor 96 propels slider 82 forwardly. The slider sprocket 88 rolls on the portion of chain 100 in trough 76, causing chain end 102 pinned to rammer head 74 to move forwardly away from the sprocket. Since the chain is backed by rammer tube 70, it remains stiff to propel the rammer head forwardly at twice the forward speed of the slider as the chain length between the sprocket and rammer head increases. FIG. 6 shows slider 82 in its forwardmost position and rammer head 74 fully extended by stiff-backed chain 100 out of the forward end of rammer tube 70 and into breech 18*a* to load projectile 72 into the cannon. Gripper 106 is then released, and the ballscrew is driven in the reverse direction to draw the rammer back to its retracted position of FIG. 5. Note that the rammer head has sufficient axial length to bridge the gap between the rammer tube and the breech bore and thus positive guidance of the rammer head during this transition is maintained. As the rammer head extends to its fully extended position to ram the projectile home, backing for the stiff-backed chain is provided by the breech bore.

To retrieve a projectile from a magazine storage tube 52, the rammer head is propelled forwardly out of the rammer tube an into the storage tube 52 in the same manner as for a ramming stroke. The gripper 106 is actuated to grip the projectile handling plug 108, and the rammer head is drawn back to its position of FIG. 5, pulling the projectile out of the storage tube and into the rammer tube where it is held under positive control during movement along the transfer path to the trolley loading position, as well as during end-for-end rotation of the rammer by motor 58 (FIG. 3) after retrieval of a projectile from bustle and hull storage magazines. In the same manner that a projectile is retrieved from one of the various magazines and loaded into the cannon, the autoloading apparatus of the invention can be controlled to retrieve a committed, but unfired projectile from the cannon breech and return it to magazine storage.

While the present invention has been described in its application to autoloading a liquid propellant cannon, it will be appreciated that it could be readily adapted to autoloading cased ammunition rounds.

It is seen from the foregoing that the objectives set forth, including those made apparent from the Detailed Description, are efficiently attained, and, since certain changes may be made in the construction set forth without departing from the scope of the present invention, it is intended that matters of detail be taken as illustrative and not in a limiting sense.

Having described the invention, what is claimed as new and desired to secure by Letters Patent is:

1. Automated apparatus for loading ammunition rounds into the breech of a cannon mounted by the revolving turret of an armored vehicle, said apparatus comprising, in combination:

A. an ammunition storage magazine mounted by the turret at a location beneath the cannon breech:

B. a trolley;

C. a rammer pivotally mounted to said trolley and including a rammer head having means for gripping an ammunition round;

D. a pair of arcuate guide tracks fixedly vertically mounted to the turret for movement in azimuth with the cannon and having a radius of curvature centered on the elevating axis of the cannon, said guide tracks controlling pitch, roll and yaw motions of said trolley for guiding movement between a magazine position and a cannon loading position;

E. means for pivoting said rammer relative to said trolley in such magazine position to extract an ammunition round from said magazine in at least one of rearward tank hull and bustle storage locations with said gripping means and being activated with said trolley in said cannon loading position to ram the ammunition into the cannon breech with said rammer head, thereby to permit round extraction from said magazine and round ramming into the cannon breech without regard to cannon elevation.

2. The automated loading apparatus defined in claim 1, wherein said pivoting means includes an electric motor carried by one of said trolley and rammer and gearing driven by said motor to rotate said rammer between essentially opposite end-for-end orientations on said trolley.

3. The automated loading apparatus defined in claim 1, which further includes an electric trolley motor, an upright ballscrew pivotally mounted at a lower end to the turret floor, and a ballnut mounted by said trolley, whereby rotation of said ballscrew by said trolley motor propels said trolley between said magazine and cannon loading positions.

4. The automated loading apparatus defined in claim 1, which further includes an electric rammer motor carried by said rammer for reciprocating said rammer head.

5. The automated loading apparatus defined in claim 4, wherein said rammer includes a rammer tube in which an ammunition round is received and through which said rammer head is reciprocated.

6. The automated loading apparatus defined in claim 1, wherein said first guide track includes a coextensive channel-shaped trackway, and said trolley includes a pair of vertically spaced rollers running in said trackway to control pitching motion of said trolley.

7. The automated loading apparatus defined in claim 6, wherein said first guide track further including a coextensive rim, and said trolley further includes a pair of vertically spaced slide blocks having slots in which said rim is received to prevent rolling motion of said trolley.

8. The automated loading apparatus defined in claim 7, wherein said second guide track is located rearwardly of said first guide track and includes a coextensive flange, and said trolley further including at least one rearwardly located guide block having a slot in which said flange is received to prevent yawing motion of said trolley.

9. The automated loading apparatus defined in claim 8, wherein the turret includes a roof and a floor, and wherein said first and second guide tracks have upper and lower ends respectively anchored to the turret roof and turret floor.

10. The automated loading apparatus defined in claim 9, wherein said first and second arcuate guide tracks include straight guide track sections as lower continuums thereof to change the pitch attitude of said trolley in said magazine position.

11. Automated apparatus for loading ammunition rounds into the breech of a cannon mounted by the revolving turret of an armored vehicle, said apparatus comprising, in combination:

A. an ammunition storage magazine mounted by the turret at a location beneath the cannon breech;

B. a trolley;

C. a rammer pivotally mounted to said trolley and including a rammer tube for receiving an ammunition round and for supporting a reciprocating rammer head equipped with a gripper for engaging the tail end of the ammunition round;

D. means for pivoting said rammer relative to said trolley into position to extract ammunition rounds from said storage magazine in at least one of rearward tank hull and turret bustle storage locations;

E. a pair of longitudinal spaced arcuate guide tracks fixedly vertically mounted to the turret and having a constant radius of curvature centered on the elevating axis of the cannon, said guide tracks controlling pitch, roll and yaw motions of said trolley for guiding movement between a magazine position, where said gripper is activated to extract an ammunition round from said magazine, and a cannon loading position where said ramming head is activated to ram the ammunition round into the cannon breech without regard to cannon elevation.

12. The automated loading apparatus defined in claim 11, wherein said rammer further includes a housing and an electric rammer motor mounted by said housing for reciprocating said rammer head through said rammer tube.

13. The automated loading apparatus defined in claim 12, wherein said rammer further includes a slider mounted by said housing for reciprocating movement parallel to the axis of said rammer tube, a sprocket rotatably mounted by said slider, a ballscrew mounted by said housing parallel to rammer tube axis and driven by said rammer motor, a ballnut carried by said slider in meshing engagement with said ballscrew, and a stiff-backed chain affixed at a first end to said housing, said chain extending along a path parallel to said rammer tube axis and wrapped around said sprocket to a second end affixed to said rammer head, whereby, upon rotation of said ballscrew in a forward direction, said slider is propelled forwardly, and said sprocket engages said chain to propel said rammer head forwardly at a speed in excess of the forward speed of said slider.

14. The automated loading apparatus defined in claim 13, wherein said rammer further includes a support mounted by said housing in position to back the portion of said chain extending from said first chain end along said path to said sprocket, said rammer tube providing backing support for the portion of said chain extending from said sprocket to said second chain end.

15. The automated loading apparatus defined in claim 14, wherein said stiff-backed chain is of a length sufficient to propel said rammer head out of said rammer tube and into a magazine storage tube to retrieve an ammunition round and into the breech bore to load the ammunition round into the cannon.

16. The automated loading apparatus defined in claim 11, wherein said pivoting means includes an electric motor carrier by one of said trolley and rammer and gearing driven by said motor to rotate said rammer between essentially opposite end-for-end orientations on said trolley.

17. The automated loading apparatus defined in claim 11, which further includes an electric trolley motor, an upright ballscrew pivotally mounted at a lower end to the turret floor, and a ballnut mounted by said trolley, whereby rotation of said ballscrew by said trolley motor propels said trolley between said magazine and cannon loading positions.

18. The automated loading apparatus defined in claim 11, wherein a first one of said pair of guide tracks include a coextensive channel-shaped trackway, and said trolley includes a pair of vertically spaced rollers running in said trackway to control pitching motion of said trolley.

19. The automated loading apparatus defined in claim 18, wherein said first guide track further includes a coextensive rim, and said trolley further includes a pair of vertically spaced slide blocks having slots in which said rim is received to prevent rolling motion of said trolley.

20. The automated loading apparatus defined in claim 19, wherein a second one of said pair of guide tracks is located rearwardly of said first guide track and includes a coextensive flange, and said trolley further including at least one rearwardly located guide block having a slot in which said flange is received to prevent yawing motion of said trolley.

21. The automated loading apparatus defined in claim 20, wherein the turret includes a roof and a floor, and wherein said first and second guide tracks have upper and lower ends respectively anchored to the turret roof and turret floor.

22. The automated loading apparatus defined in claim 21, wherein said first and second arcuate guide tracks include straight guide track sections as lower continuums thereof to change the pitch attitude of said trolley in said magazine position.

* * * * *